United States Patent [19]

Cromeens

[11] 3,946,700

[45] Mar. 30, 1976

[54] GLUE APPLICATOR

[75] Inventor: Jeff Y. Cromeens, Garland, Tex.

[73] Assignee: Industrial Woodworking Machine Co. Inc., Garland, Tex.

[22] Filed: Mar. 19, 1974

[21] Appl. No.: 452,612

[52] U.S. Cl. ..... 118/259; 118/DIG. 9

[51] Int. Cl.[2] ..... B05C 1/02

[58] Field of Search ..... 118/259, 603, DIG. 9, 258, 118/261; 15/31, 34

[56] References Cited

UNITED STATES PATENTS

| | | | |
|---|---|---|---|
| 778,709 | 12/1904 | Robertson | 118/DIG. 9 |
| 2,150,837 | 3/1939 | Magnuson | 118/259 X |
| 2,157,724 | 5/1939 | Zablocki | 118/259 X |
| 2,898,618 | 8/1959 | Whitfield et al. | 118/259 X |
| 2,989,940 | 6/1961 | Williams | 118/259 X |
| 3,135,006 | 6/1964 | Leland | 118/259 X |

*Primary Examiner*—John P. McIntosh
*Attorney, Agent, or Firm*—Joseph H. Schley; Thomas L. Cantrell

[57] ABSTRACT

Disclosed is a glue applicator for applying glue to an uneven generally vertical surface having a generally upright rotary brush with a compartmented doctor block at one side thereof. Glue is pumped into the feed compartment and onto the brush which then wipes it onto the work piece. Glue recovery means are provided below the brush for recycling unused glue, and a shield is preferably provided around part of the brush to minimize splattering. The doctor block compartment may be in the form of an open-sided tube, or may comprise a series of serrations in the doctor block.

3 Claims, 10 Drawing Figures

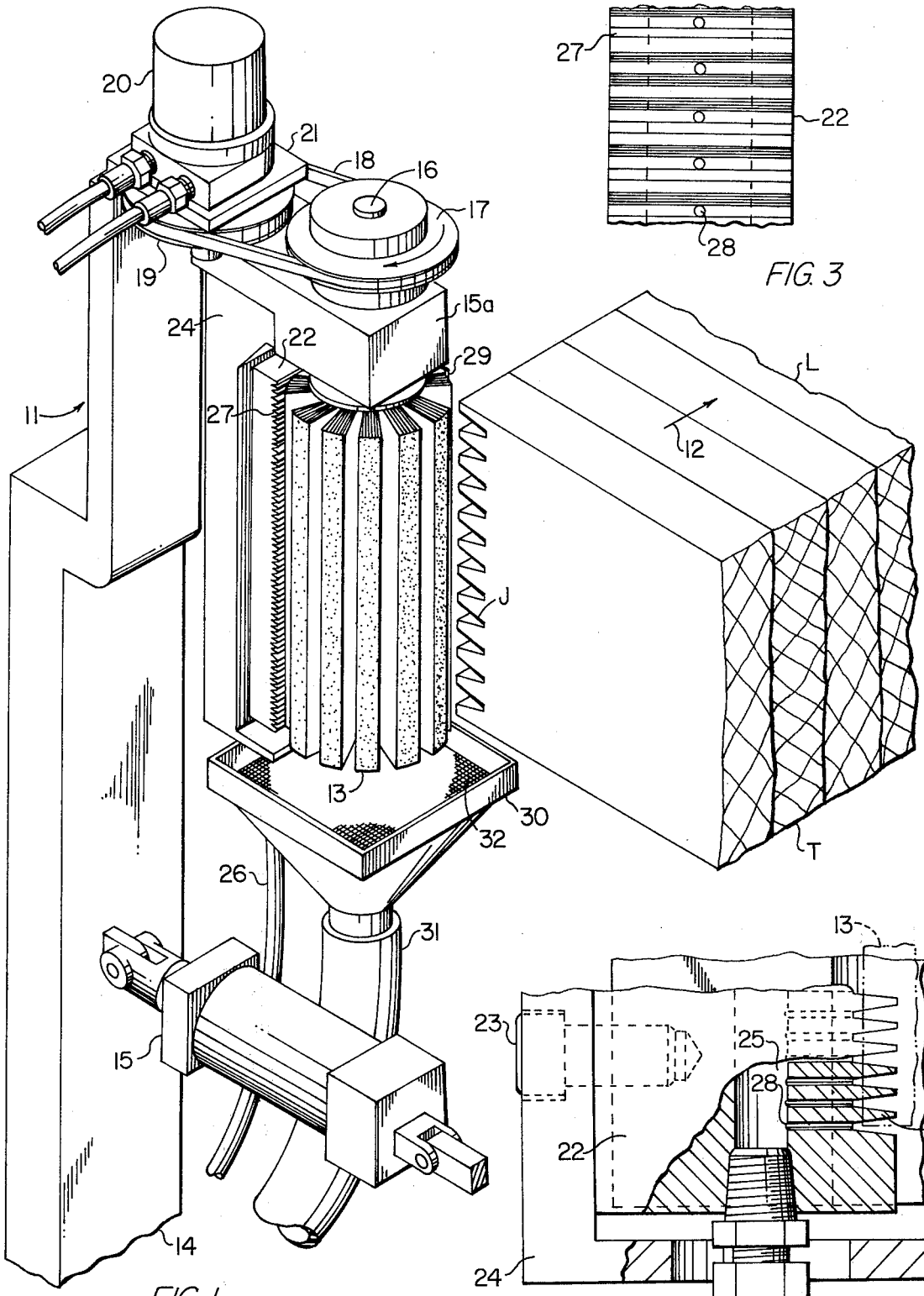
FIG. 1
FIG. 3
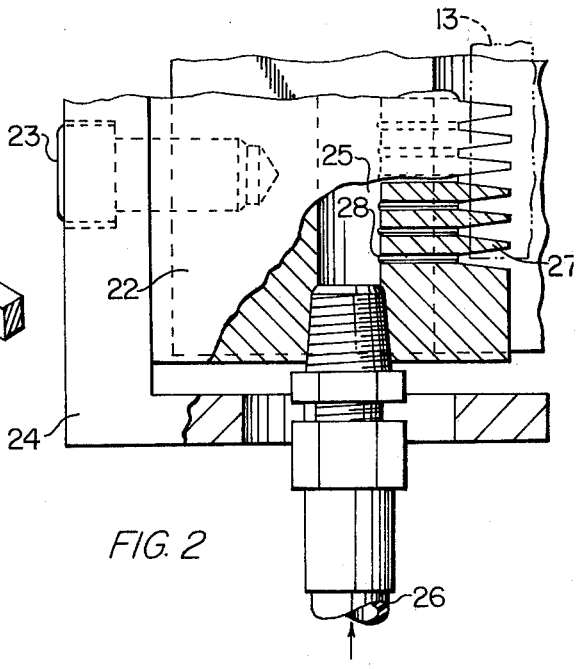
FIG. 2

GLUE APPLICATOR

BACKGROUND OF THE INVENTION

In the production of finger jointed lumber, it is necessary to apply glue to the finger-cut (serrated) ends of the sticks of lumber in preparation for joining the sticks end-to-end to form a longer length of lumber. The glue is generally applied while the stick is held on its side or edge, and the finger-cut end is thus vertical, and may be characterized as an uneven vertical surface. The term "glue" is used herein in a broad sense to include both protein glue and other types of adhesives which are in a flowable condition prior to curing.

It is essential to the formation of a sound lumber finger joint that the entire finger-cut end surface of at least one of the sticks making up the joint being coated with glue, and coated as uniformly as possible. At the same time, it is desired to keep glue off the sides of the lumber, and to waste as little glue as possible through spillage.

In order to impart the desired mechanical strength to a finger joint, it is the practice to finger-cut the ends fairly deeply (typically about 9/16 inch with variations encountered from about ⅛ inch to about 1 ½ inches), making the surface of the end very uneven, and making it difficult to apply glue evenly on the surface, because the application tool must reach both the deep-cut regions of the end and the shallower portions, and deposit on them a uniform layer of glue. Furthermore, since for various operational reasons it is most common that the surface to be coated is oriented vertically, and since the glue during the application stage is a liquid, it is difficult to load the application tool with glue uniformly from top to bottom and to maintain such uniform loading, and it is thus difficult to apply a uniform layer of glue across the surface to be coated from top to bottom.

SUMMARY OF THE INVENTION

In accordance with the invention, there is provided a rotary brush type glue applicator which overcomes the difficulties outlined above, and which is capable of applying a controllable uniform coating of adhesive to finger-cut ends and other uneven vertical surfaces. The invention utilizes a rotary power driven brush mounted with its axis vertical. The brush is preferable positioned with respect to a work piece station so that the bristles reach into the uneven vertical surfaces of the end of a work piece sufficiently to apply glue to the farthermost portions thereof when the work piece is positioned in or moving through the station.

In further accordance with the invention, glue is supplied to the vertical brush while it is rotating against the end of the work piece through a specially configured doctor block. The doctor block has a compartment formed in its surface which faces and contacts the brush, and means for delivering glue into the compartment from a source of supply. The doctor block is preferably positioned with respect to the vertical axis of the brush so that it is located at least in part within the relaxed volume of the brush. Stated alternately, the vertical surface of the doctor block is spaced from the axis of the brush a distance less than the nominal radius of the brush, with the consequence that the bristles wipe into the compartment of the doctor block to pick up glue being pumped into the compartment. This arrangement insures that glue is supplied uniformly to the brush from top to bottom, and that it is deposited "in" the brush rather than merely on its outer surface. A uniform load of glue is thus continuously placed uniformly in the brush in a location ideal for transfer by wiping action onto the entire uneven vertical surface of a finger-cut lumber end.

As the glue-laden brush rotates, centrifugal force will tend to move the glue toward the surface of the brush and to throw it off the brush. This effect is beneficial in the zone of contact between the brush and the work piece, but in the region between the doctor block and the zone of contact it is undesirable since glue thrown off the brush is wasted. For this reason it is preferred that an arcuate shield be provided between the doctor block and the zone of contact, extending around the periphery of the brush.

Because the glue being delivered to the brush and wiped onto the uneven vertical surface is flowable, it will tend to migrate downwardly in the brush and drop off the bottom, particularly when the brush is stopped for any reason. In accordance with the invention, a screened funnel or other glue recovery means is preferably positioned below the brush to catch the glue and return it to the supply reservoir.

From the foregoing, it can be seen that a principal object of the invention is to provide an improved glue applicator for applying glue to an uneven vertical surface such as a finger-cut lumber end.

Another object of the invention is the provision of a glue applicator capable of applying a uniform glue coating to an uneven vertical surface.

A further object of the invention is to provide a glue applicator which is economical in the use of glue because of the elimination of splatter and the recycle of unused glue.

The manner in which the foregoing objects are achieved, together with other objects and purposes, can best be understood by a consideration of the detailed description which follows, together with the accompanying drawings.

DESCRIPTION OF THE DRAWINGS

FIG. 1 is a fragmentary perspective view of a glue applicator assembly constructed in accordance with the invention;

FIG. 2 is a fragmentary side elevational view, partly in section, of the lower portion of the glue applicator of FIG. 1 and showing the glue passages of its doctor block;

FIG. 3 is a fragmentary elevational view of a portion of the face of the doctor block of the applicator of FIG. 1;

DESCRIPTION OF THE PREFERRED EMBODIMENTS

Figure 6:
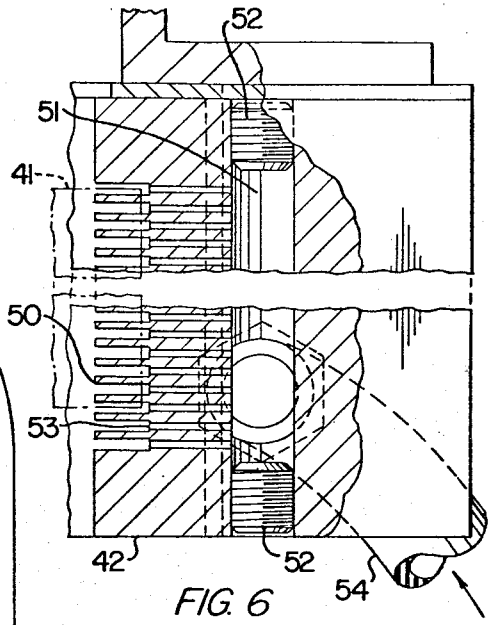
FIG. 6 is an enlarged broken sectional view, partly in elevation, of the upper and lower portions of the doctor block of the embodiment of FIG. 4.
Figure 7:
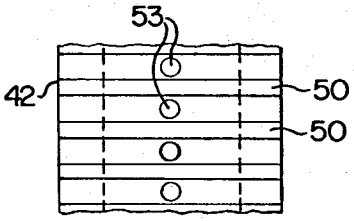
FIG. 7 is a fragmentary elevational view of a portion of the face of said doctor block.
Figure 4:
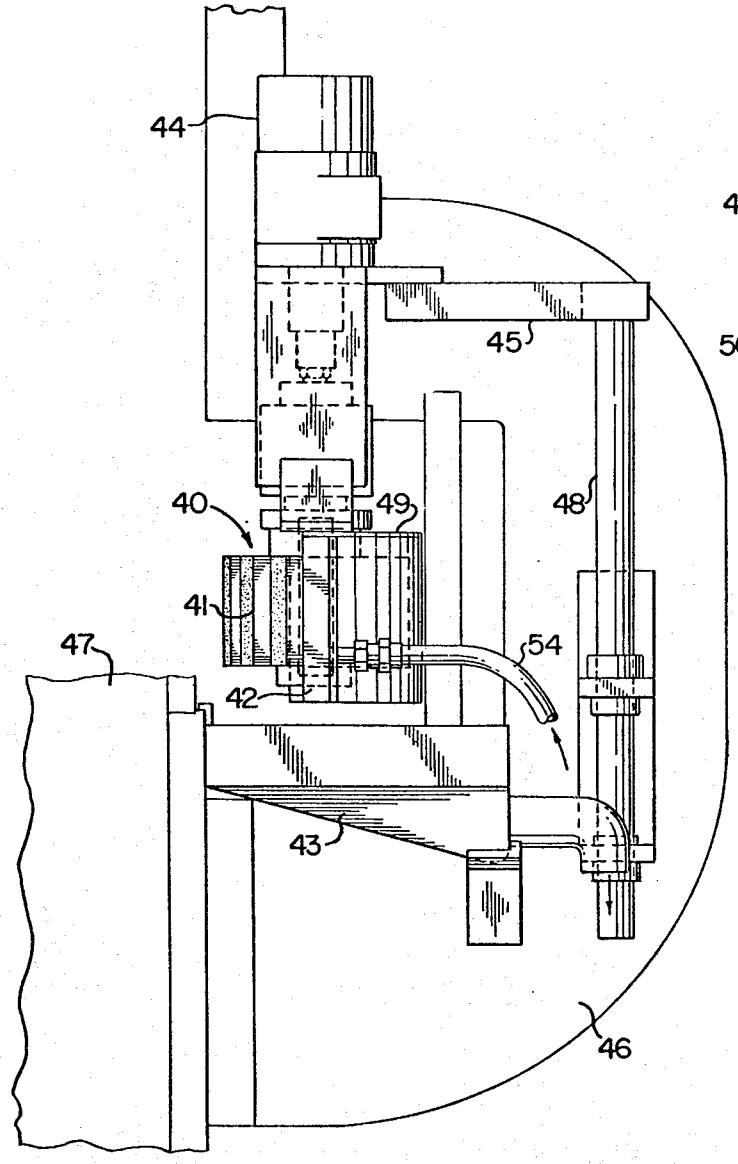
FIG. 4 is a side elevational view of another embodiment of the glue applicator of the invention.
Figure 5:
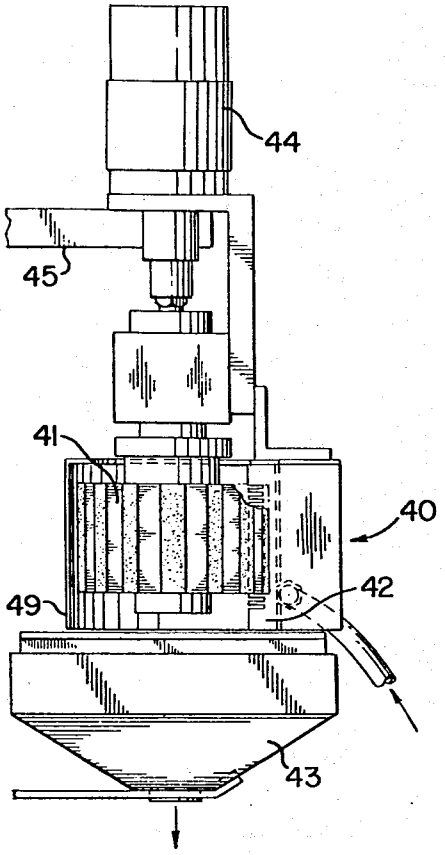
FIG. 5 is a front elevational view of the glue applicator of FIG. 4.

Attention is first directed to FIGS. 1–3 which illustrate one embodiment of the invention. In FIG. 1, the glue applicator is designated generally as 11. It is designed to apply glue to the serrated or finger-cut ends of an array of lumber L, the array being formed of a plurality of timbers or sticks T. The finger-cut ends of the timbers T are indicated at J. The array L is carried past the applicator 11 by conveying equipment which is not shown, in the direction indicated by the arrow 12. If desired, the timbers T may be brought into the zone of contact with applicator 11 one-at-a-time, instead of in an array L, and they may be brought into the zone of contact from directions other than that indicated by the arrow 12.

The glue applicator 11 comprises an upright rotary brush 13 positioned adjacent the line of travel of the array L for contact with the serrated or finger-jointed ends J of the timbers or sticks T so as to spread glue or other adhesive thereon. An upright standard or leg 14 for supporting the applicator assembly 11 has its lower end pivotally attached, to part of the frame of an associated piece of woodworking or conveying equipment, and is actuated by suitable pneumatic or hydraulic means 15 whenever it is desired to retract the brush from operative position in contact with the lumber array L, such as when the travel of the lumber L stops. The leg 14 has a block 15*a*, of greater length than width, projecting laterally inward from its upper end, and an upright shaft 16 is journalled in and suspended from the inner end portion of the block for rotatably supporting the brush 13. A pulley 17 is fixed on the upper end of the shaft 16 and is driven by an endless belt 18 which is trained over the drive pulley 19 of a suitable motor 20 mounted on a lateral inwardly projecting extension 21 at the upper end of the upright leg.

Glue or other suitable adhesive is adapted to be applied to the brush by an upright doctor blade or block 22 mounted between the leg 14 and brush by screws 23 (FIG. 2) on an upright angular bracket 24 which is suspended from the block 15*a*. A passage 25 extends longitudinally of the doctor blade 22 and its lower end communicates with a line 26 (FIG. 2) which leads from the pump of a glue pot or reservoir (conventional, not shown) for conducting glue to a feed compartment formed by an upright row of horizontal fingers or serrations 27 which extend posteriorly from the passage into engagement with the peripheral portion of the brush 13. Ports 28 (FIGS. 2 and 3) are disposed between the fingers 27 in communication with the passage 25 and the spaces between said fingers. Preferably, an upright guard or shield 29, arcuate in plan, is secured to the trailing side of the bracket 25 in close proximity to the trailing portions of the fingers and brush to prevent undesirable spattering of the glue, and excess glue is collected by a screened funnel 30 which underlies the brush 13 and drains through a return hose 31 into the glue pot. It is noted that the glue brush is rotated by the motor 20, belt 18, and pulleys 17 and 19 in a direction opposite to the travel of the lumber.

It can be seen from FIG. 2 that the tips of the fingers or serrations 27 of the doctor block 22 penetrate into the brush 13, which means that the glue is deposited well into the brush instead of merely on the surface.

It is preferred that motor 20, which is illustrated in FIG. 1 as of the hydraulic type, be variable in speed.

Such variability gives an additional element of controllability to the operation of the unit. Thus, brush speed may be set or changed in view of glue consistency, work piece velocity, depth of finger-cuts, type of wood, etc.

It will be noted from FIG. 1 that the excess glue collector funnel 30 is provided with a screen or filter 32. Since woodworking operations are inherently dusty, the use of screen 32 is very desirable to prevent workroom dust (mainly sawdust) from entering the glue pot through the recycle stream.

Attention is now directed to FIGS. 4–7, which show another embodiment of the invention. In these figures, the glue applicator is designated generally as 40. Like the embodiment of FIGS. 1–3, it includes a vertically mounted brush 41, a serrated doctor block 42, an excess glue funnel 43, a brush drive motor 44, and support means for this equipment 45. In this instance the support means 45 is cantilevered outwardly from a vertical plate 46 mounted to one side of the work piece conveyor 47 (see FIG. 4). The support means 45 includes rod 48 about which the brush motor and doctor block portion of the unit can be pivoted to and away from the work station adjacent conveyor 47.

The embodiment of FIGS. 4–7 differs from that of FIGS. 1–3 in several respects. First, motor 44 is aligned axially with brush 41. Second, doctor block 42 is relatively narrow as compared to doctor block 22, and is located at right angle to the zone of contact between the brush and work piece, instead of being located across the brush from the zone of contact. Compare FIG. 1 with FIGS. 4 and 5. Since the doctor block 42 is much closer to the zone of contact in the embodiment of FIGS. 4–7, there is no need for an anti-splatter screen between it and the zone. However, an arcuate anti-splatter screen 49 is provided which extends from the zone of contact back around the brush to the other side of the doctor block 42.

The doctor block 42, aside from being narrower than doctor block 22 (FIG. 1), is much like it in structure. Thus, it has a feed compartment formed by serrations 50, which extend into the body of brush 41. It should be noted that serrations 50 are rectangular in profile instead of V-shaped. Compare FIGS. 2 and 6. A bore 51, closed at its ends by plugs 52, runs vertically through doctor block 42, behind serrations 50. Ports or apertures 53 provide communication between the base of each serration 50 and bore 51. Glue is pumped into bore 51 through line 54 which enters the bore from the side.

Figure 10:
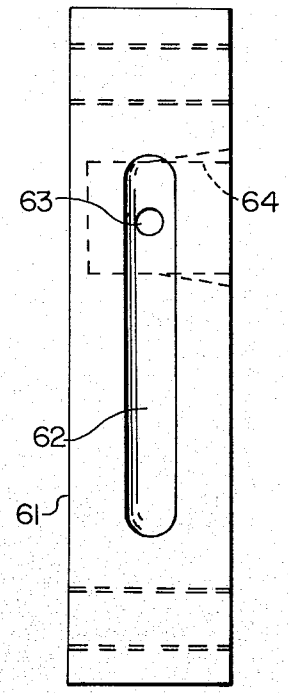
FIG. 10 is a front elevational view of the face of the doctor block of FIG. 9.
Figure 9:
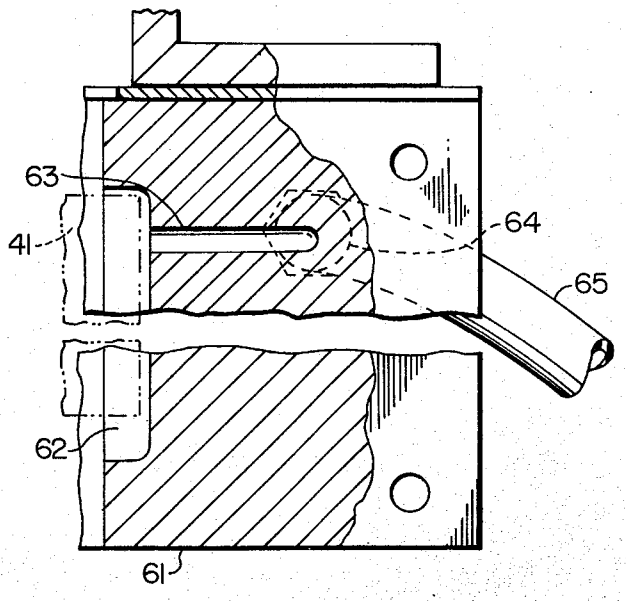
FIG. 9 is an enlarged broken sectional view, partly in elevation, of the upper and lower portions of the doctor block of the embodiment of FIG. 8.
Figure 8:
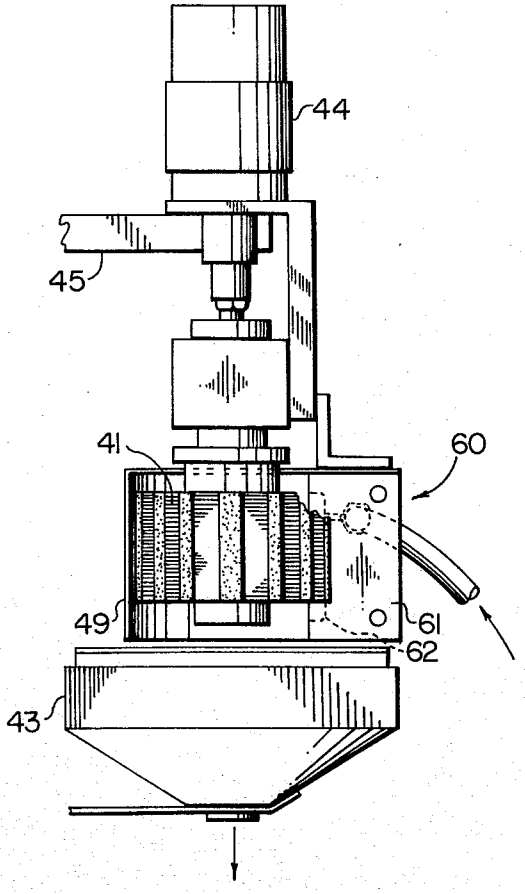
FIG. 8 is a front elevational view of still another embodiment of the glue applicator of the invention.

Attention is now directed to FIGS. 8 through 10 which illustrate another embodiment of the invention. In many respects the structure of this embodiment is much like that of the embodiment shown in FIGS. 4 through 7, and for this reason the parts which are substantially identical in structure and function are given the same reference characters. For these parts, reference should be made to the description above of FIGS. 4 through 7 for an understanding of their structure and function.

The applicator 60 of the embodiment of FIGS. 8 through 10 includes a doctor block 61 of modified structure. It has a compartment 62 in its face, which compartment is in the form or shape of an open-sided cylindrical tube. Bores 63 and 64 provide communication between glue supply line 65 and compartment 62. The bores 63 and 64 are positioned in the doctor block to feed glue to the top of compartment 62 instead of to the bottom as was the case in the embodiments discussed earlier. As can best be seen in FIGS. 8 and 9, the doctor block 61 is positioned with respect to brush 41 so that the bristles of the brush 41 wipe into compartment 62 to pick up glue therefrom. The face of the doctor block 61 in which compartment 62 is formed serves as a shield to prevent glue splatter caused by the bristles of brush 41 moving out of the compartment 62. In addition, the wiping of the bristles of brush 41 across the face of doctor block 61 after they leave compartment 62 tends to spread the glue to the bristles more evenly and uniformly, before they enter into contact with the finger-jointed lumber end.

From the foregoing it can be seen that there is provided, in accordance with the invention, a glue applicator especially suited for applying a uniform coating of glue to an uneven vertical surface, such as the finger-cut end of a piece of lumber.

What is claimed is:

1. A glue applicator for applying glue to an uneven upright surface comprising an upright rotary brush;

glue delivery means for the brush including a doctor block positioned beside said brush and having an upright flat surface oriented parallel to the axis of said brush and spaced therefrom a distance less than the nominal radius of the brush, a glue feed compartment in the upright surface of the doctor block for receiving and applying glue to said brush and being in the shape of an upright open-sided tube;

glue supply means;

said doctor block having a passage in communication with the glue feed compartment and the glue supply means; and means positioned below said brush for catching glue falling from said brush and returning it to said supply means.

2. A glue applicator for applying glue to an uneven upright surface comprising an upright rotary brush;

glue delivery means for the brush including a doctor block positioned beside said brush and having an upright surface oriented parallel to the axis of said brush and spaced therefrom a distance less than the nominal radius of the brush, a glue feed compartment in the upright surface of the doctor block for receiving and applying glue to said brush and being in the form of a multiplicity of transverse serrations;

glue supply means;

said doctor block having a passage in communication with the glue feed compartment and the glue supply means; and means positioned below said brush for catching glue falling from said brush and returning it to said supply means.

3. A glue applicator as defined in claim 2 wherein the passage of said doctor block includes a vertical bore and lateral ports establishing communication between the bore and the base portions of the transverse serrations of said upright surface of said block.

* * * * *